US010316731B2

(12) United States Patent
Park et al.

(10) Patent No.: US 10,316,731 B2
(45) Date of Patent: Jun. 11, 2019

(54) METHOD AND SYSTEM FOR CONTROLLING COOLANT CIRCULATING IN ENGINE

(71) Applicants: Hyundai Motor Company, Seoul (KR); Kia Motors Corporation, Seoul (KR)

(72) Inventors: Cheol Soo Park, Gyeonggi-do (KR); Bonghoon Han, Seoul (KR); Dong Suk Chae, Seoul (KR); Kwang Sik Yang, Gyeonggi-do (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 69 days.

(21) Appl. No.: 15/266,782

(22) Filed: Sep. 15, 2016

(65) Prior Publication Data

US 2017/0248067 A1 Aug. 31, 2017

(30) Foreign Application Priority Data

Feb. 26, 2016 (KR) ..... 10-2016-0023096

(51) Int. Cl.
*F01P 7/16* (2006.01)
*F01P 7/14* (2006.01)

(52) U.S. Cl.
CPC ..... *F01P 7/16* (2013.01); *F01P 2007/146* (2013.01); *F01P 2023/08* (2013.01);
(Continued)

(58) Field of Classification Search
CPC ..... F01P 7/16; F01P 2025/30; F01P 2025/32; F01P 2025/50; F01P 2037/00;
(Continued)

(56) References Cited

U.S. PATENT DOCUMENTS

2004/0122612 A1 6/2004 Mann et al.
2004/0144340 A1* 7/2004 Kilger ..... F01P 7/164 123/41.1

(Continued)

FOREIGN PATENT DOCUMENTS

EP 1279800 A2 1/2003
JP 05-231148 A 9/1993

(Continued)

OTHER PUBLICATIONS

European Patent Office, Munich, Germany, Extended European Search Report for European Patent Application No. 16187397.1 in the name of Hyundai Motor Company et al. dated Aug. 3, 2017, Five (5) pages.

*Primary Examiner* — Jacob M Amick
(74) *Attorney, Agent, or Firm* — Brinks Gilson & Lione

(57) ABSTRACT

The present disclosure provides a method and system, for controlling a coolant circulating in an engine, including: selecting a reference inlet temperature for a coolant flowing through a coolant inlet of an engine; controlling an open rate of the coolant control valve unit based on the reference inlet temperature; sensing an actual inlet temperature of the coolant flowing through the coolant inlet of the engine; sensing an actual outlet temperature of a coolant flowing through a coolant outlet of the engine; calculating a difference value between the actual inlet temperature and the actual outlet temperature; and varying the reference inlet temperature according to the difference value.

6 Claims, 4 Drawing Sheets

(52) U.S. Cl.
CPC ..... *F01P 2025/13* (2013.01); *F01P 2025/30* (2013.01); *F01P 2025/32* (2013.01); *F01P 2025/50* (2013.01); *F01P 2025/62* (2013.01); *F01P 2025/64* (2013.01); *F01P 2037/00* (2013.01)

(58) Field of Classification Search
CPC ..... F01P 2025/64; F01P 2025/62; F01P 2025/13; F01P 2007/146; F01P 2023/08
See application file for complete search history.

(56) References Cited

U.S. PATENT DOCUMENTS

| | | | | |
|---|---|---|---|---|
| 2011/0265742 | A1 | 11/2011 | Choi et al. | |
| 2016/0160739 | A1* | 6/2016 | Ichihara ..... | F01P 7/16<br>123/41.09 |

FOREIGN PATENT DOCUMENTS

| | | | |
|---|---|---|---|
| JP | 05-332136 | A | 12/1993 |
| JP | 2000-274244 | A | 10/2000 |
| JP | 2004156490 | A | 6/2004 |
| JP | 2013-057292 | A | 3/2013 |
| KR | 20110120766 | A | 11/2011 |

* cited by examiner

METHOD AND SYSTEM FOR CONTROLLING COOLANT CIRCULATING IN ENGINE

CROSS-REFERENCE TO RELATED APPLICATION

This application claims priority to and the benefit of Korean Patent Application No. 10-2016-0023096, filed on Feb. 26, 2016, the entire contents of which are incorporated herein by reference.

FIELD

The present disclosure relates to a method and system for controlling a coolant circulating in an engine that may accurately control a coolant temperature.

BACKGROUND

The statements in this section merely provide background information related to the present disclosure and may not constitute prior art.

Generally, a mechanical thermostat is used to control a temperature of a coolant circulating in an engine, and the mechanical thermostat has a structure in which wax of the mechanical thermostat expands to open a coolant flow path connected to a radiator and to control the temperature of the coolant when the temperature of the coolant increases.

The mechanical thermostat is disposed at a coolant outlet of an engine to control an outlet temperature of the engine or at a coolant inlet of the engine to control an inlet temperature of the engine, wherein the former is referred to as an engine outlet control method and the latter is referred to as an engine inlet control method.

Since the engine outlet control method senses a temperature of a coolant flowing out of the engine and then performs predetermined control, it is possible to prevent the temperature of the coolant from being excessively increased, but since a point for sensing the temperature of the coolant is positioned at the coolant outlet of the engine, accuracy of the control may be degraded.

In contrast, since the engine inlet control method senses the temperature of the coolant at an inlet of the engine, variation of the temperature of the coolant is small and accuracy of the control is high, but the temperature of the outlet of the engine may excessively increase according to output of the engine.

The above information disclosed in this Background section is only for enhancement of understanding of the background of the disclosure and therefore it may contain information that does not form the prior art that is already known to a person of ordinary skill in the art.

Further areas of applicability will become apparent from the description provided herein. It should be understood that the description and specific examples are intended for purposes of illustration only and are not intended to limit the scope of the present disclosure.

SUMMARY

The present disclosure provides a method and system for controlling a coolant circulating in an engine that may implement advantages of an engine inlet control method and an engine outlet control method and may rapidly and accurately control a temperature of the coolant.

Particularly, the present disclosure provides a method and system for controlling a coolant circulating in an engine that may rapidly and accurately control a temperature of the coolant by correcting an inlet temperature reference value of the coolant according to a difference value between a coolant temperature of an engine outlet and a coolant temperature of an engine inlet.

Further, the present disclosure provides a method and system for controlling a coolant circulating in an engine that includes a coolant control valve unit that is electronically controlled and that may control a temperature of a coolant supplied to an inlet of the engine by respectively controlling a coolant supplied to a radiator and a coolant bypassing the radiator.

One form of the present disclosure provides a method for controlling a coolant circulating in an engine, including: selecting a reference inlet temperature for a coolant flowing through a coolant inlet of an engine; controlling an open rate of the coolant control valve unit based on the reference inlet temperature; sensing an actual inlet temperature of the coolant flowing through the coolant inlet of the engine; sensing an actual outlet temperature of a coolant flowing through a coolant outlet of the engine; calculating a difference value between the actual inlet temperature and the actual outlet temperature; and varying the reference inlet temperature according to the difference value.

The reference inlet temperature may be selected based on the actual outlet temperature of the coolant flowing through the coolant outlet of the engine.

The coolant control valve unit may supply a coolant discharged from the coolant outlet of the engine to the radiator or to the coolant inlet of the engine by bypassing the radiator, and it may respectively control the coolant supplied to the radiator and the coolant inlet of the engine according to the open rate of the coolant control valve unit.

As the difference value between the actual inlet temperature and the actual outlet temperature increases, a correction value of the reference inlet temperature may increase.

When the reference inlet temperature is lowered, the coolant control valve unit may increase an amount of the coolant supplied to the radiator.

As the difference value between the actual inlet temperature and the actual outlet temperature increases, the reference inlet temperature may be lowered.

The actual inlet temperature and the actual outlet temperature may be respectively sensed by first and second coolant temperature sensors.

The coolant may be pumped to the coolant inlet of the engine by a coolant pump.

Another form of the present disclosure provides a system for controlling a coolant circulating in an engine, including: an engine configured to generate torque through a combustion process, for a coolant to be supplied to a coolant inlet thereof, and for the coolant to be discharged from a coolant outlet thereof; first and second coolant temperature sensors that are respectively installed at the coolant inlet and the coolant outlet to sense a temperature of the coolant; a radiator that is installed at one side of the engine to discharge heat of the coolant to the outside; a coolant control valve unit that is installed at the coolant outlet to distribute a coolant discharged from the engine to the radiator or to the coolant inlet by bypassing the radiator; and a controller that senses the temperature of the coolant through the first and second coolant temperature sensors, controls the coolant control valve unit, selects a reference inlet temperature for a coolant flowing through the coolant inlet, controls an open rate of the coolant control valve unit based on the reference inlet temperature, senses an actual inlet temperature of the coolant flowing through the coolant inlet, senses an actual outlet temperature of the coolant flowing through the coolant outlet, calculates a difference value between the actual inlet temperature and the actual outlet temperature, and varies the reference inlet temperature according to the difference value.

The reference inlet temperature may be selected based on the actual outlet temperature of the coolant flowing through the coolant outlet of the engine.

As the difference value between the actual inlet temperature and the actual outlet temperature increases, a correction value of the reference inlet temperature may increase.

When the reference inlet temperature is lowered, the coolant control valve unit may increase an amount of the coolant supplied to the radiator.

As the difference value between the actual inlet temperature and the actual outlet temperature increases, the reference inlet temperature may be lowered.

The system may further include a coolant pump that is disposed at the coolant inlet of the engine to pump the coolant to the coolant outlet.

According to one form of the present disclosure, it is possible to rapidly and accurately control a temperature of the coolant by correcting an inlet temperature reference value of the coolant according to a difference value between a coolant temperature of an engine outlet and a coolant temperature of an engine inlet.

According to one form of the present disclosure, it is possible to provide a coolant control valve unit that is electronically controlled and that may control a temperature of a coolant supplied to an inlet of the engine by respectively controlling a coolant supplied to a radiator and a coolant bypassing the radiator.

That is, it is possible to actively follow and control the temperature of the coolant actually flowing in the engine by controlling a flow rate of the coolant flowing from the radiator for cooling the coolant and the coolant bypassed by the coolant control valve unit, and by controlling the temperature of the coolant supplied to the inlet of the engine.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
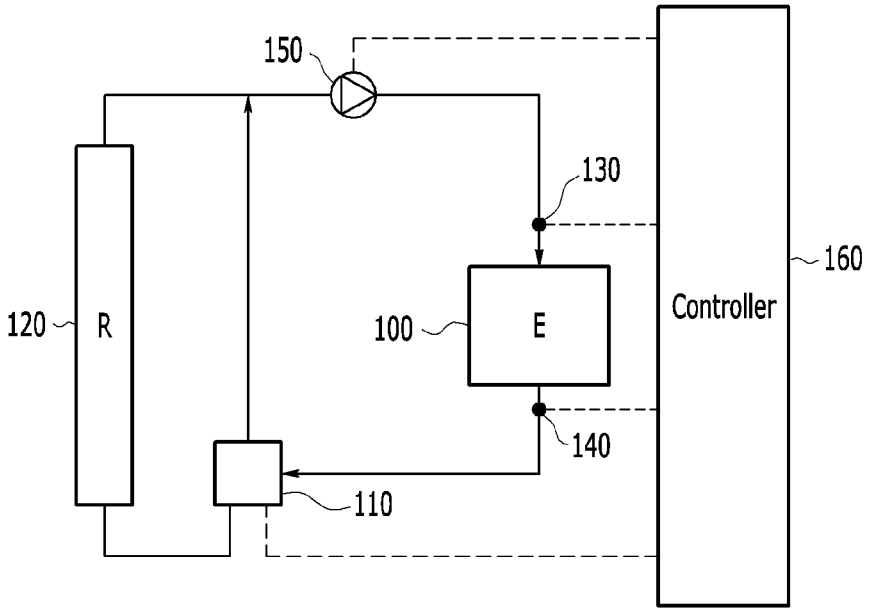
FIG. 1 illustrates a schematic diagram of a system for controlling a coolant circulating in an engine according to one form of the present disclosure.

The drawings described herein are for illustration purposes only and are not intended to limit the scope of the present disclosure in any way.

DESCRIPTION OF SYMBOLS

| | |
|---|---|
| 100: engine | 110: coolant control valve unit |
| 120: radiator | 130: first coolant temperature sensor |
| 140: second coolant temperature sensor | |
| 150: coolant pump | |
| 160: controller | 300: valve housing |
| 305: port | 310: rotary valve |

DETAILED DESCRIPTION

The following description is merely exemplary in nature and is not intended to limit the present disclosure, application, or uses. It should be understood that throughout the drawings, corresponding reference numerals indicate like or corresponding parts and features.

Forms of the present disclosure will hereinafter be described in detail with reference to the accompanying drawings.

FIG. 1 illustrates a schematic diagram of a system for controlling a coolant circulating in an engine according to one form of the present disclosure.

Referring to FIG. 1, a system for controlling a coolant circulating in an engine includes an engine 100, a first coolant temperature sensor 130, a second coolant temperature sensor 140, a coolant control valve unit 110, a radiator 120, a coolant pump 150, and a controller 160.

The first coolant temperature sensor 130 is disposed at a coolant inlet of the engine 100 to sense a temperature of a coolant flowing into the engine through the coolant inlet, and the second coolant temperature sensor 140 is disposed at a coolant outlet of the engine 100 to sense a temperature of a coolant flowing out of the engine through the coolant outlet.

The radiator 120 serves to radiate or dissipate heat of a supplied coolant to the outside, and the coolant pump 150 pumps the coolant supplied from the radiator 120 or the coolant control valve unit 110 to circulate the coolant from the coolant inlet to the coolant outlet of the engine 100.

The coolant control valve unit 110 is electronically controlled by the controller 160 to respectively control the coolant supplied to the radiator 120 and the coolant bypassing the radiator 120. Moreover, the coolant control valve unit 110 may control the coolant to not flow when the temperature of the coolant is equal to or less than a predetermined temperature.

In one form of the present disclosure, the coolant control valve unit 110 is electronically controlled by the controller 160 to continuously and variably control a flow amount of the coolant supplied to the radiator 120 and the coolant bypassing the coolant control valve unit 110.

The controller 160 may be implemented by one or more processors operated by a predetermined program, and the predetermined program may include a series of commands for performing a method according to one form of the present disclosure described later.

First of all, the controller 160 controls the coolant control valve unit 110, for example, the controller 160 controls a coolant temperature of the coolant inlet of the engine 100 based on a predetermined reference inlet temperature. In other words, the controller 160 controls the coolant control valve unit 110 so that the coolant temperature of the coolant inlet of the engine 100 reaches the reference inlet temperature (e.g., about 90° C.).

Then, actual inlet and outlet coolant temperatures of the engine 100 are sensed through the first coolant temperature sensor 130 and the second coolant temperature sensor 140, and a difference value between the actual inlet and outlet coolant temperatures is calculated.

In addition, the reference inlet temperature is varied according to the difference value, and the coolant control valve unit 110 is controlled based on the varied reference inlet temperature. Accordingly, it is possible to actively control the temperature of the coolant circulating in the engine 100 and to variably control the temperature of the coolant according to a load of the engine 100.

Figure 2:
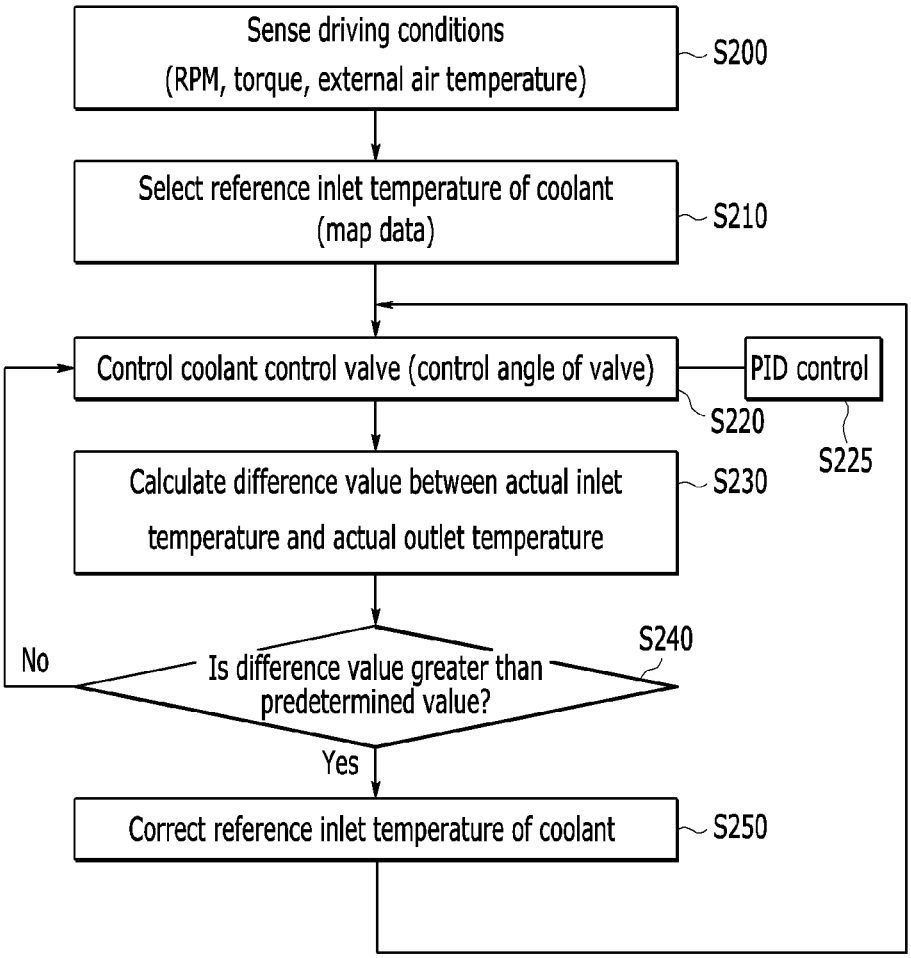
FIG. 2 illustrates a flowchart of a method for controlling a coolant circulating in an engine according to one form of the present disclosure.

FIG. 2 illustrates a flowchart of a method for controlling a coolant circulating in an engine according to one form of the present disclosure.

Referring to FIG. 2, driving conditions are sensed at step S200. In this case, the driving conditions include Revolutions per Minute (RPM) of the engine, torque of the engine, an external air temperature, etc.

The controller 160 selects the reference inlet temperature of the coolant from map data at step S210. The reference inlet temperature may be one selected from predetermined data, or may be an actual outlet temperature of the coolant sensed by the second coolant temperature sensor 140.

The controller 160 controls the coolant control valve unit 110 based on the reference inlet temperature at step S220. For example, the controller 160 continuously controls a valve angle of the coolant control valve unit 110 so that the inlet temperature of the coolant follows the reference inlet temperature, and the controller 160 controls a flow amount of the coolant flowing in the radiator 120 and a flow amount of the coolant flowing in the coolant control valve unit 110, thereby controlling the temperature of the coolant inflowing through the coolant inlet of the engine 100.

In this case, a proportional-integral-derivative (PID) control may be performed to control a valve open degree of the coolant control valve unit 110 at step S225.

The controller 160 senses the actual outlet temperature of the coolant through the second coolant temperature sensor 140 at step S230. In addition, the controller 160 senses the actual inlet temperature of the coolant through the first coolant temperature sensor 130, and the controller 160 calculates the difference value between the actual inlet temperature and the actual outlet temperature of the coolant at step S230.

The controller 160 determines whether the difference value is greater than the predetermined value and whether a state in which the difference value is greater than the predetermined value is maintained during a predetermined time at step S240.

If the difference value is not greater than the predetermined value or the state in which the difference value is greater than the predetermined value is not maintained during the predetermined time, the process of step S220 is performed to normally control the coolant flowing through the radiator and the coolant control valve unit, and if the difference value is greater than the predetermined value and the state in which the difference value is greater than the predetermined value is maintained during the predetermined time, the reference inlet temperature of the coolant is corrected or changed at step S250.

Alternatively, if the difference value between the actual inlet temperature and the actual outlet temperature is greater than the predetermined value and the state in which the difference value is greater than the predetermined value is maintained during the predetermined time, the actual inlet temperature of the coolant flowing through the coolant inlet of the engine may be corrected to be lower.

In one form of the present disclosure, the controller 160 determines that the difference value between the actual inlet temperature and the actual outlet temperature increases as that the load of the engine 100 increases to be able to further lower the reference inlet temperature.

When the reference inlet temperature is lowered through the coolant control valve unit 110, the controller 160 may variably increase an amount of the coolant supplied from the coolant control valve unit 110 to the radiator 120.

Figure 3:
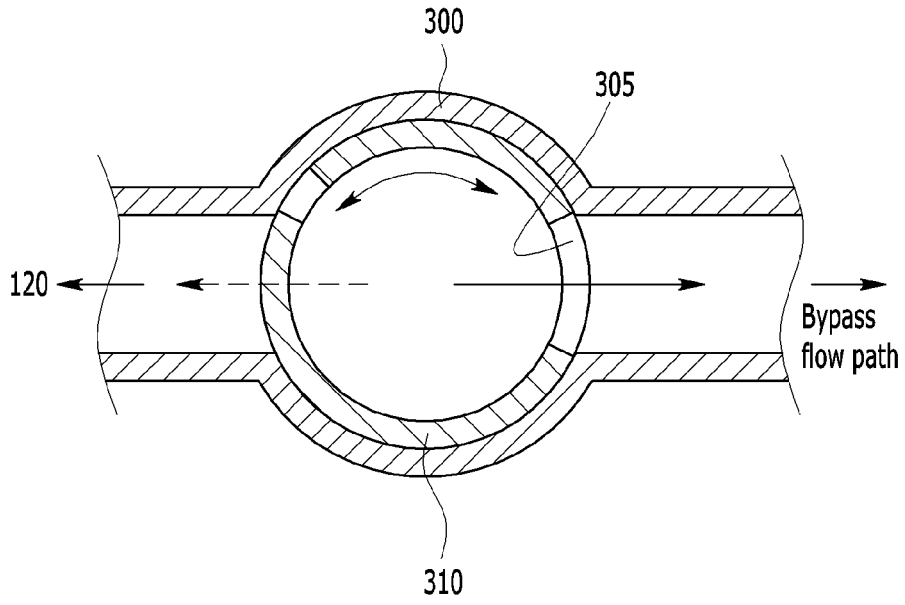
FIG. 3 illustrates a schematic cross-sectional view for explaining an operation principle of a coolant control valve unit for controlling a coolant circulating in an engine according to one form of the present disclosure.

FIG. 3 illustrates a schematic cross-sectional view for explaining an operation principle of a coolant control valve unit for controlling a coolant circulating in an engine according to one form of the present disclosure.

Referring to FIG. 3, the coolant control valve unit 110 includes a valve housing 300 and a rotary valve 310. The rotary valve 310 is provided with a port 305 for the coolant to flow from the inside to the outside, and the port 305 is disposed in a predetermined position of the rotary valve 310.

The port 305 is selectively connected to the radiator 120 or a bypass flow path according to a rotation position of the rotary valve 310, thus the coolant supplied to a central portion of the rotary valve 310 is distributed to the radiator 120 or the bypass flow path.

Figure 4:
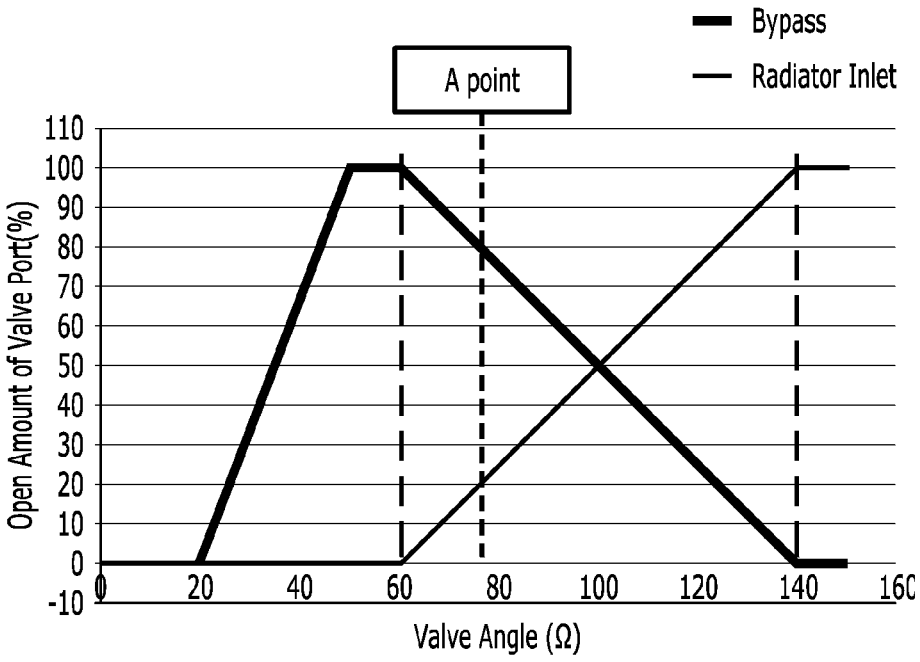
FIG. 4 illustrates a graph of a coolant control pattern according to one form of the present disclosure.

FIG. 4 illustrates a graph of a coolant control pattern according to one form of the present disclosure.

Referring to FIG. 4, a horizontal axis thereof indicates the rotation position of the rotary valve 310, and a vertical axis thereof indicates an open amount of the port 305.

Specifically, when the rotation position of the rotary valve 310 is an angle of approximately 60 degrees, the port is opened by approximately 100% at a side of the bypass flow path and is opened by approximately 0% at a side of the radiator 120.

When the rotation position of the rotary valve 310 is an angle of approximately 80 degrees, the port is opened by approximately 80% at a side of the bypass flow path and is opened by approximately 20% at a side of the radiator 120, and an open rate of the port 305 connected to the radiator 120 or to the bypass flow path may be continuously varied according to the rotation position of the rotary valve 310.

Accordingly to one form of the present disclosure, by respectively sensing the temperatures of the coolant inlet and the coolant outlet of the engine 100 and then controlling the temperature of the coolant, it is possible to relatively constantly maintain the coolant temperature of the coolant outlet of the engine 100 and to minimize variation of the coolant temperature according to the load of the engine 100.

Since the control performance for the coolant temperature varies according to the inlet and outlet positions of the engine using the conventional mechanical thermostat, although there are limitations in designing the engine in the conventional art, the control according to one form of the present disclosure is performed according to the coolant temperatures of the inlet and outlet of the engine 100 regardless of the position of the coolant control valve, thus flexibility for designing the engine is improved.

Further, according to one form of the present disclosure, controllability for the coolant is stably maintained in a transient state such as sudden acceleration or a sudden stop.

According to one form of the present disclosure, the first coolant temperature sensor 130 is installed between the coolant pump 150 and the coolant inlet of the engine at a lower side of a portion at which the outlet of the radiator 120 and the outlet of the coolant control valve unit 110 are merged, the second coolant temperature sensor 140 is installed at the coolant outlet of the engine 100, the open rate of the coolant control valve unit 110 is controlled by the PID control according to the difference between the temperatures of the coolant inlet and outlet of the engine 100, and the coolant flowing through the radiator 120 and the coolant flowing through the coolant control valve unit 110 are continuously controlled, thereby accurately and rapidly controlling the coolant temperature of the coolant inlet of the engine 100.

Further, when the difference value between the coolant temperatures of the coolant inlet and outlet is determined to be greater than the predetermined value, it is possible to actively control the coolant temperature in the transient sate of the engine 100 by increasing or decreasing the coolant temperatures of the coolant inlet.

While this disclosure has been described in connection with what is presently considered to be practical forms, it is to be understood that the disclosure is not limited to the disclosed forms, but, on the contrary, is intended to cover various modifications and equivalent arrangements included within the spirit and scope of present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method for controlling coolant circulating in an engine, the method comprising:

selecting a reference inlet temperature for a coolant flowing through a coolant inlet of an engine;

continuously controlling a coolant flowing through a radiator and a coolant flowing through a coolant control valve unit by controlling an open rate of the coolant control valve unit based on the reference inlet temperature;

sensing an actual inlet temperature of the coolant flowing through the coolant inlet of the engine;

sensing an actual outlet temperature of a coolant flowing through a coolant outlet of the engine;

calculating a difference value between the actual inlet temperature and the actual outlet temperature; and varying the reference inlet temperature according to the difference value and controlling an open amount of the coolant control valve unit to follow the varied reference inlet temperature, wherein the actual inlet temperature and the actual outlet temperature are respectively sensed by a first and a second coolant temperature sensor, wherein the coolant is pumped to the coolant inlet of the engine by a coolant pump, wherein the first coolant temperature sensor is installed between a back end of the coolant pump and the coolant inlet of the engine, wherein the coolant control valve unit supplies a coolant discharged from the coolant outlet of the engine to at least one of the radiator and the coolant inlet of the engine by bypassing the radiator, and the coolant control valve unit respectively controls the coolant supplied to the radiator and the coolant inlet of the engine according to the open rate of the coolant control valve unit, wherein as the difference value between the actual inlet temperature and the actual outlet temperature increases, a correction value of the reference inlet temperature increases, and wherein when the reference inlet temperature is lowered, the coolant control valve unit increases an amount of the coolant supplied to the radiator.

2. The method for controlling coolant circulating in an engine of claim 1, wherein the reference inlet temperature is selected based on the actual outlet temperature of the coolant flowing through the coolant outlet of the engine.

3. The method for controlling coolant circulating in an engine of claim 1, wherein as the difference value between the actual inlet temperature and the actual outlet temperature increases, the reference inlet temperature is lowered.

4. A system for controlling coolant circulating in an engine, the system comprising:

an engine configured to generate torque through a combustion process, the engine configured for a coolant to be supplied to a coolant inlet thereof and for the coolant to be discharged from a coolant outlet thereof;

first and second coolant temperature sensors that are respectively installed at the coolant inlet and the coolant outlet to sense a first and a second temperature of the coolant respectively;

a radiator that is installed at one side of the engine to dissipate heat of the coolant;

a coolant control valve unit that is installed at the coolant outlet to distribute a coolant discharged from the engine to at least one of the radiator and to the coolant inlet by bypassing the radiator;

a coolant pump that is disposed at the coolant inlet of the engine to pump the coolant to the coolant outlet; and a controller that senses the first and the second temperatures of the coolant through the first and second coolant temperature sensors respectively, controls the coolant control valve unit, selects a reference inlet temperature for a coolant flowing through the coolant inlet, controls an open rate of the coolant control valve unit based on the reference inlet temperature, senses an actual inlet temperature of the coolant flowing through the coolant inlet, senses an actual outlet temperature of the coolant flowing through the coolant outlet, calculates a difference value between the actual inlet temperature and the actual outlet temperature, and varies the reference inlet temperature according to the difference value, wherein the first coolant temperature sensor is installed between a back end of the coolant pump and the coolant inlet of the engine, wherein as the difference value between the actual inlet temperature and the actual outlet temperature increases, a correction value of the reference inlet temperature increases, and wherein when the reference inlet temperature is lowered, the coolant control valve unit increases an amount of the coolant supplied to the radiator.

5. The system for controlling coolant circulating in an engine of claim 4, wherein the reference inlet temperature is selected based on the actual outlet temperature of the coolant flowing through the coolant outlet of the engine.

6. The system for controlling coolant circulating in an engine of claim 4, wherein as the difference value between the actual inlet temperature and the actual outlet temperature increases, the reference inlet temperature is lowered.

* * * * *